US006877802B2

(12) United States Patent
Christensen et al.

(10) Patent No.: US 6,877,802 B2
(45) Date of Patent: Apr. 12, 2005

(54) FOLDABLE INFANT SEAT

(75) Inventors: Myles T. Christensen, Reading, PA (US); Michael L. Longenecker, Ephrata, PA (US); George Campbell, Wilmington, DE (US)

(73) Assignee: Graco Children's Products Inc., Exton, PA (US)

( * ) Notice: Subject to any disclaimer, the term of this patent is extended or adjusted under 35 U.S.C. 154(b) by 0 days.

(21) Appl. No.: 10/413,580

(22) Filed: Apr. 15, 2003

(65) Prior Publication Data

US 2004/0207235 A1 Oct. 21, 2004

(51) Int. Cl.[7] ..... A47D 1/02
(52) U.S. Cl. ..... 297/16.1; 297/DIG. 11
(58) Field of Search ..... 297/DIG. 11, 16.1, 297/452.13, 452.2, 334, 440.15, 258.1, 325; 5/111, 114

(56) References Cited

U.S. PATENT DOCUMENTS

| | | | | | |
|---|---|---|---|---|---|
| 2,250,094 | A | * | 7/1941 | Cornibert et al. | 450/31 |
| 4,141,095 | A | * | 2/1979 | Adachi | 5/108 |
| 4,188,678 | A | | 2/1980 | Rawolte | |
| 4,471,551 | A | * | 9/1984 | Mattarelli | 42/70.01 |
| 4,867,505 | A | | 9/1989 | Parker | |
| 5,172,955 | A | | 12/1992 | Freese et al. | |
| 5,207,478 | A | | 5/1993 | Freese et al. | |
| 5,269,591 | A | | 12/1993 | Miga, Jr. et al. | |
| 5,308,143 | A | | 5/1994 | Cheng et al. | |
| 5,411,315 | A | | 5/1995 | Greenwood | |
| 5,449,220 | A | * | 9/1995 | Taylor et al. | 297/344.15 |
| 5,451,095 | A | | 9/1995 | Riback | |
| 5,460,430 | A | | 10/1995 | Miga, Jr. et al. | |
| 5,507,564 | A | * | 4/1996 | Huang | 297/452.13 |
| 5,509,721 | A | | 4/1996 | Huang | |
| 5,868,459 | A | | 2/1999 | Welsh, Jr. | |
| 6,341,816 | B1 | | 1/2002 | Chen et al. | |
| 6,361,106 | B1 | * | 3/2002 | Huang | 297/32 |
| 6,540,292 | B2 | * | 4/2003 | Darling et al. | 297/130 |
| 6,616,237 | B2 | * | 9/2003 | Sonner et al. | 297/440.22 |
| 6,679,779 | B2 | * | 1/2004 | Tai et al. | 472/95 |
| 6,682,137 | B2 | * | 1/2004 | Hsia | 297/32 |
| 6,682,148 | B1 | * | 1/2004 | Chen | 297/440.24 |

FOREIGN PATENT DOCUMENTS

| | | | | |
|---|---|---|---|---|
| DE | 3304443 | A1 * | 8/1984 | A47D/1/08 |
| DE | 86 01 798.5 | | 9/1986 | |
| EP | 1 029 735 | A2 | 8/2000 | |
| GB | 2 382 523 | A | 6/2003 | |

OTHER PUBLICATIONS

Web Pages for Snugli Car Ride Baby Bouncer by Evenflo, 1 pp. (date unknown), available at http://www.netkid-swear.com/snugcarridbo.html.

Web Pages for Snugli Bounce & Play Bouncer by Evenflo, 1 pp (date unknown), available at http://www.yahoo.com/babyant/snugbounplay.html.

* cited by examiner

*Primary Examiner*—Peter M. Cuomo
*Assistant Examiner*—Stephen D'Adamo
(74) *Attorney, Agent, or Firm*—Foley & Lardner LLP

(57) ABSTRACT

A foldable infant seat includes a base, configured to support the seat on a surface, and an upper frame. Each side of the base includes a first frame member and a second frame member pivotally connected together. Each side of the upper frame includes a third frame member and a fourth frame member pivotally connected together. The first frame member of the base and the third frame member of the upper frame on each side of the seat are pivotally connected together. The infant seat also includes a link on each side of the seat that is pivotally connected to the base and to an intermediate portion of the upper frame. The base, the upper frame, and the link are moveable between an in use position and a folded position, and a length of the base is greater in the in use position than in the folded position.

22 Claims, 11 Drawing Sheets

FOLDABLE INFANT SEAT

FIELD OF THE INVENTION

This invention relates to an infant seat, such as a bouncer seat. More specifically, this invention relates to an infant seat that folds compactly for storage and travel.

BACKGROUND OF THE INVENTION

Infant seats that allow an infant to lie in a slightly upright position have been known for many years. These infant seats generally include a frame having a base and a seat support angled up from the base at an appropriate angle. A fabric covering is mounted over the seat support to receive the infant. Some of these infant seats incorporate a bounce feature. For example, the frame can be designed so that the seat support can be "bounced" relative to the base. This bouncing movement often soothes and pacifies the infant.

Infant seats typically are lightweight so that a caregiver can pick up and move the infant seat to any room in the house. The caregiver thus can keep the infant close, yet need not hold the infant at all times. Although the infant seats are portable, the frame of most infant seats is fixed. Thus, once assembled, the infant seat cannot be easily collapsed or stored compactly. In addition, because the infant seat cannot be collapsed, it is inconvenient to take the infant seat on vacations or other travel.

In an effort to make infant seats more portable and more easily stored, some infant seats have been designed with frames in which the base of the frame can pivot relative to the seat support of the frame. These infant seats can include a pivot at a location at the front of the seat where the base meets the seat support; that is, where the seat support angles up from the base. Thus, the infant seat frame can be collapsed into a relatively flat arrangement. In addition, some infant seats have been designed so that the seat support of the frame includes a pivot so that the seat support can be folded into a more compact arrangement. Although, when these latter infant seats are collapsed, the height dimension of the infant seats can be made smaller, and the length of the seat support of the frame can be shortened, the length of the base of the infant seat frame remains the same. That is, the infant seat, when in the collapsed position, has a length at least equal to the length of the base of the infant seat frame.

Thus, there is a need for an infant seat that can be folded into a very compact arrangement for travel and storage.

SUMMARY OF THE INVENTION

An aspect of the present invention relates to a foldable infant seat that comprises a base, configured to support the seat on a surface, and an upper frame. Each side of the base includes a first frame member and a second frame member pivotally connected together. Each side of the upper frame includes a third frame member and a fourth frame member pivotally connected together. The first frame member of the base and the third frame member of the upper frame on each side of the seat are pivotally connected together. The foldable infant seat also comprises a link on each side of the seat that is pivotally connected to the base and to an intermediate portion of the upper frame. The base, the upper frame, and the link are moveable between an in use position and a folded position, and a length of the base is greater in the in use position than in the folded position.

Another aspect of the present invention relates to a foldable infant seat that comprises a base, configured to support the seat on a surface, and an upper frame. Each side of the base has first and second tubular frame members pivotally connected together. The upper frame is pivotally connected to the base. The infant seat is configurable in an in use position and a folded position, and the base has a shorter length in the folded position than in the in use position.

Another aspect of the present invention relates to a foldable infant seat that comprises a generally U-shaped base, configured to support the seat on a surface, and a generally U-shaped upper frame. The base is foldable at a location intermediate a front end of the base and a back end of the base. The upper frame is pivotally connected to the base at a front of the seat. The upper frame is foldable at a location intermediate a front end of the upper frame and a back end of the upper frame, and the base and the upper frame are moveable between an in use position and a folded position. The infant seat also comprises a link on each side of the seat that extends between the base and an intermediate portion of the upper frame.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several embodiments of the invention and, together with the description, serve to explain the principles of the invention.

FIG. 2A illustrates the sleeve prior to actuation of the fold mechanism and FIG. 2B illustrates the sleeve during actuation of the fold mechanism.

FIG. 4A illustrates the sleeve prior to actuation of the fold mechanism and FIG. 4B illustrates the sleeve during actuation of the fold mechanism.

DETAILED DESCRIPTION OF THE PREFERRED EMBODIMENTS

Reference will now be made in detail to presently preferred embodiments of the invention, examples of which are illustrated in the accompanying drawings. An effort has been made to use the same reference numbers throughout the drawings to refer to the same or like parts.

Figure 1:
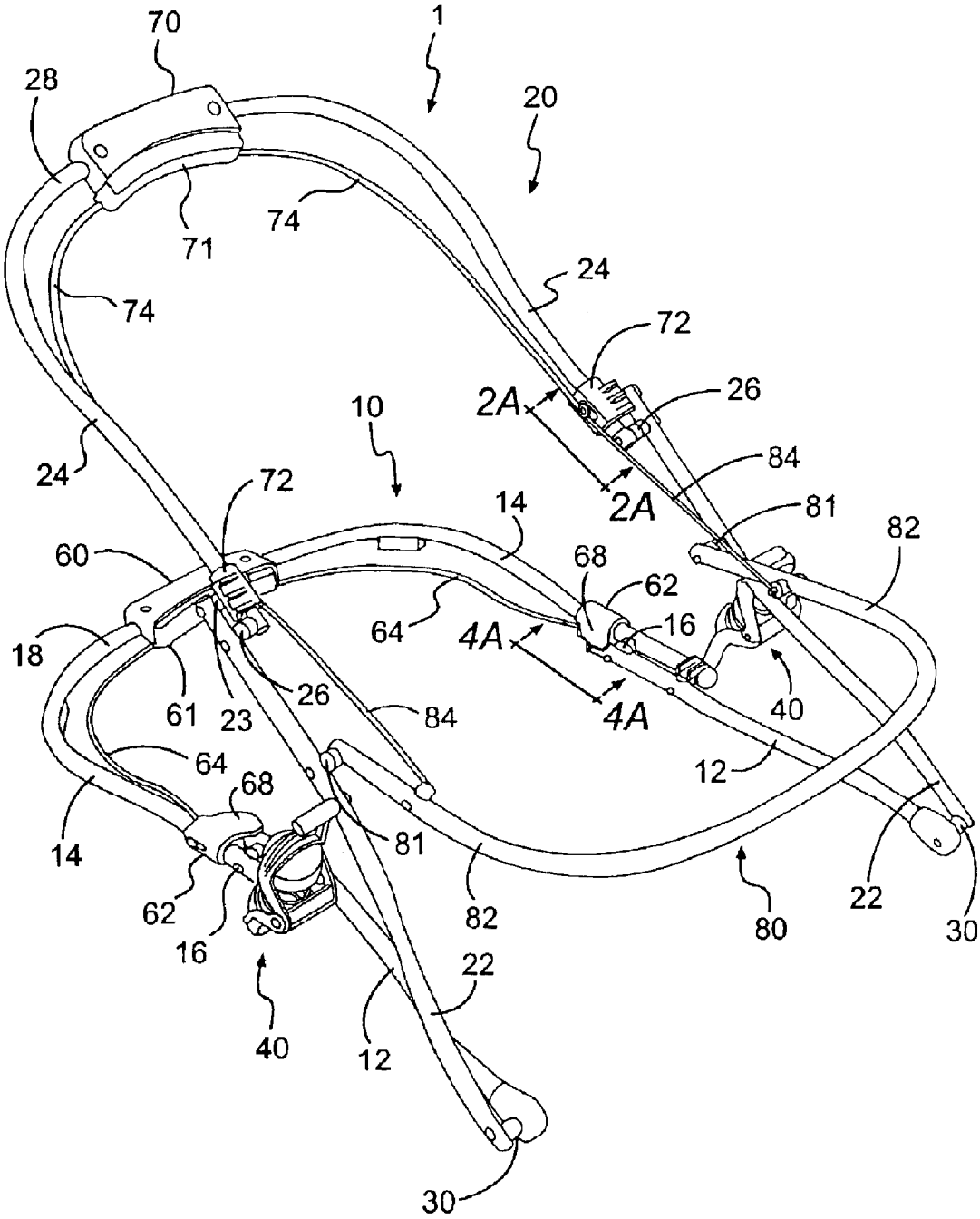
FIG. 1 is a front perspective view that illustrates a foldable frame of an infant seat according to an exemplary embodiment of the present invention.
Figure 11:
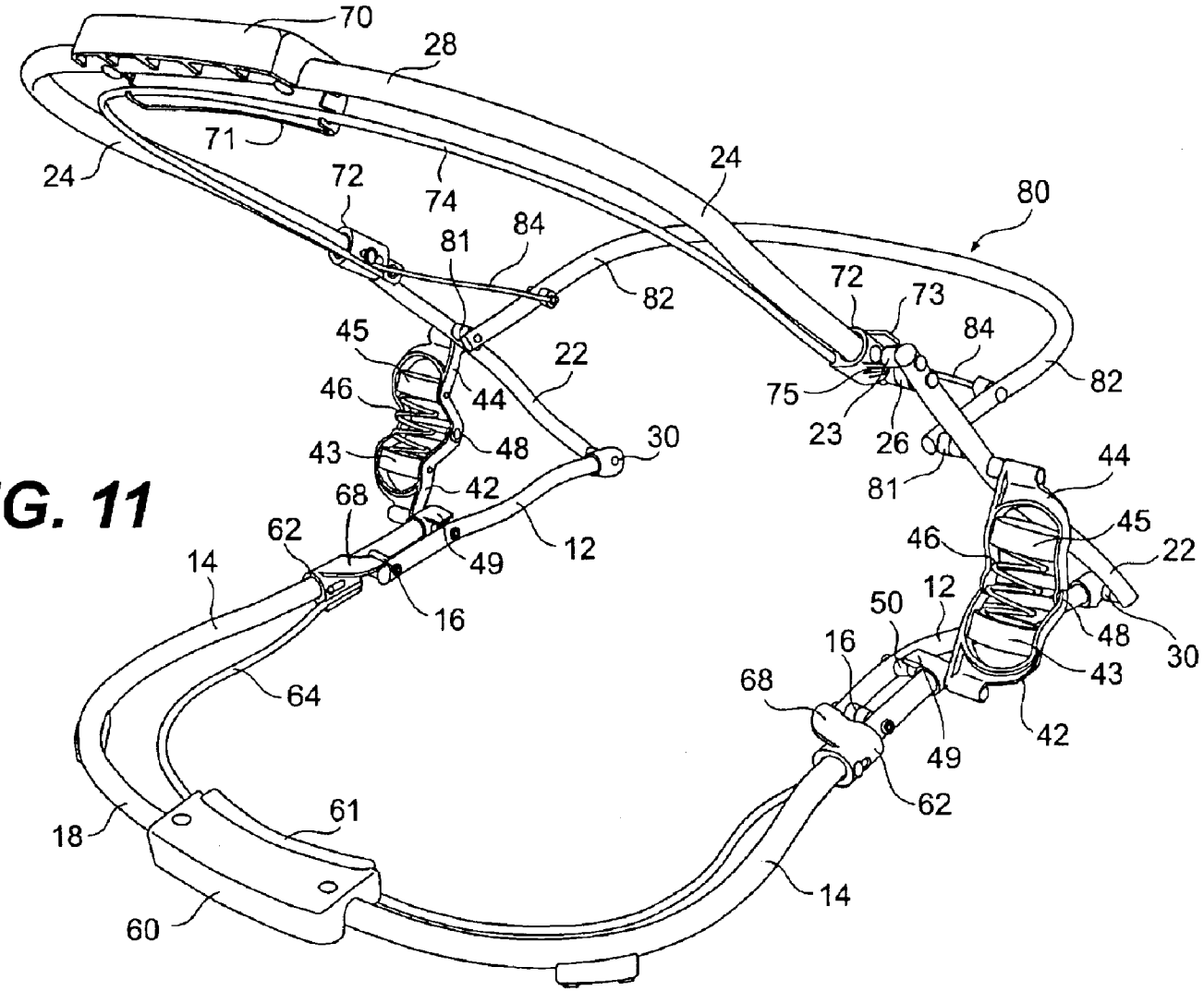
FIG. 11 is a rear perspective view of the foldable frame of the infant seat of FIG. 1.

FIGS. 1 and 11 illustrate a foldable infant seat 1 according to an exemplary embodiment of the invention. The foldable infant seat is designed to move between an in use position and a compact folded position. In this regard, the foldable infant seat can fold both along the base of the seat and along the upper frame of the seat, as will be described in more detail below. The folding ability of the infant seat facilitates storage of the seat when not in use, as well as portability of the seat. For example, the foldable infant seat of the present invention can be folded to a size small enough to fit within a suitcase for family vacations and, thus, is particularly suited for travel.

The foldable infant seat 1 of FIGS. 1 and 11 generally includes a base 10 and an upper frame 20. The base 10 is configured to support the seat 1 on a surface. Each side of the base 10 includes a first frame member 12 and a second frame member 14. The first and second frame members are pivotally connected together at pivots 16. In the embodiment shown in the Figures, the base 10 further includes a cross member 18 that extends between the rear ends of the second frame members 14 to form a generally U-shaped base frame member. It will be understood, however, that in other embodiments, the second frame members 14 need not be connected, but rather can be spaced apart from each other along their entire length. Further, the first frame members 12 in this embodiment are spaced from each other along their entire length.

The upper frame 20 of the foldable infant seat 1 is configured to support an infant. A fabric covering (not shown) can be mounted to the upper frame 20, and an infant can be placed upon, and supported by, the fabric covering. Each side of the upper frame 20 generally includes a third frame member 22 and a fourth frame member 24. The third and fourth frame members are pivotally connected together at pivots 26. In the embodiment shown in the Figures, the upper frame 20 further includes a cross member 28 that extends between the rear ends of the fourth frame members 24 to form a generally U-shaped upper frame member. It will be understood, however, that in other embodiments, the second frame members 24 need not be connected, but rather can be spaced apart from each other along their entire length.

The first frame members 12 of the base 10 and the third frame members 22 of the upper frame 20 are pivotally connected together at pivots 30 on either side of the infant seat 1. Pivots 16, 26, 30 allow the base 10 and the upper frame 20 of the infant seat 1 to move between an in use position (see FIG. 1) and a fully folded position (see FIGS. 9 and 10) as will be described in more detail below. Pivots 16, 26, and 30 can be formed by pins that extend through the pivotally connected frame members, or by any other suitable pivot fastener.

The infant seat 1 further includes a link, for example, spring assembly 40, on each side of the seat 1. Each link is pivotally connected to the base 10 and to an intermediate portion of the upper frame 20 (that is, between the front end and the back end of the upper frame 20). The base 10, the upper frame 20, and the link are moveable between the in use position and the folded position, as can be seen from FIGS. 1, 9, and 10. In addition, the length of the base 10 and the length of the upper frame 20 are greater in the use position than in the folded position. Accordingly, when the infant seat 1 is in the folded position, it is sized for travel and occupies little storage space.

In the embodiment shown in the Figures, each link is pivotally connected to, and extends between, the respective second frame member 14 of the base 10 and the respective third frame member 22 of the upper frame 20. The link can be connected to a front end of the second frame member 14 and to an intermediate portion of the third frame member 22 (that is, between the front end and the back end of the third frame member 22). The link can comprise a rigid frame member, such as metal tubing, or, alternatively, and as shown in the Figures, the link can comprise a resilient member, such as spring assembly 40. As seen best in FIGS. 5 and 11, the spring assembly 40 can include a first spring mount 42 pivotally connected to the second frame member 14, a second spring mount 44 pivotally connected to the third frame member 22, and a spring 46 extending between the first and second spring mounts 42, 44. The spring mounts 42, 44 each can include a cap 43, 45, respectively, to trap an end of the spring 46 in the spring mounts 42, 44. The first and second spring mounts 42, 44 are pivotally connected together by a pivot 48, such as a pivot pin. The pivot 48 allows the first and second spring mounts 42, 44 to move relative to each other while the infant seat 1 is in the in use position so that the upper frame 20 can bounce relative to the base 10.

Each first frame member 12 can include a stop 50, and each first spring mount 42 can include an extension 49 dimensioned to be supported on the stop 50 when the infant seat 1 is in the in use position. Engagement of the extension 49 with the stop 50 maintains the second frame members 14 in its in use position relative to the first frame members 12 to create the base 10 of the seat 1.

Figure 4A:
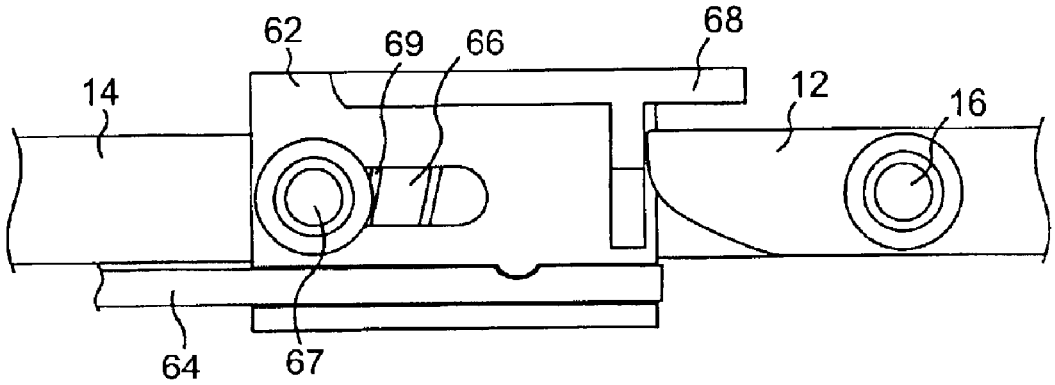
FIGS. 4A and 4B are enlarged side views of a sleeve of a fold mechanism of a base of the infant seat of FIG. 1, where
Figure 4B:
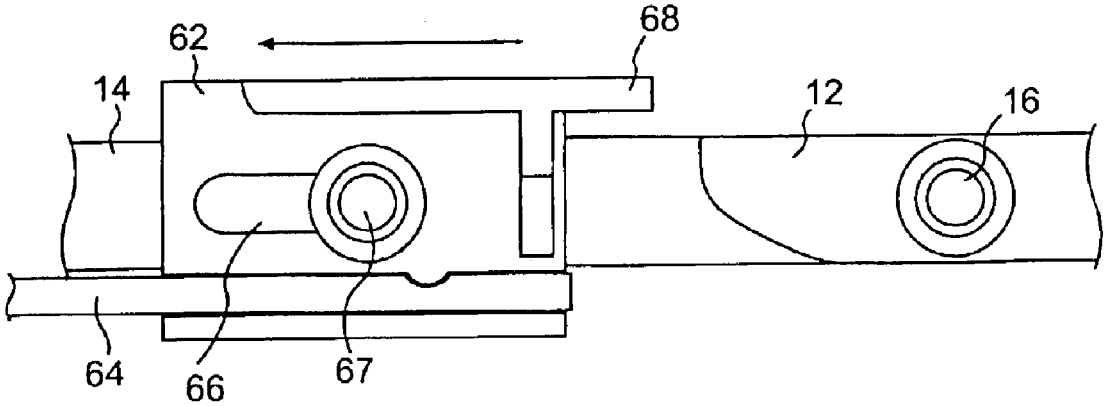

To facilitate folding of the infant seat 1, the seat 1 can include a fold mechanism mounted to the base 10 to control folding of the base 10 from the in use position to the folded position. The fold mechanism can include a fold actuator 60 mounted to a base frame member, such as the cross member 18. The fold mechanism also can include a sleeve 62 slidably mounted to each of the second frame members 14 to move between a first position in which the base 10 remains in the in use position and a second position in which the base 10 can fold. FIG. 4A shows the sleeve 62 in the first position, and FIG. 4B shows the sleeve 62 in the second position. The fold mechanism further can include an actuator arm 64 extending between the fold actuator 60 and each sleeve 62. The actuator arm 64 can comprise a U-shaped wire with the bight of the "U" connected to the fold actuator 60, or it can comprise a pair of wires connected to the fold actuator 60, one wire extending to each sleeve.

Referring to FIGS. 4A and 4B, the sleeve 62 includes a slot 66 and an extension 68 that at least partially overlaps the respective first frame member 12 to prevent folding of the base 10 absent actuation of the fold actuator 60. A pin 67 connected to the second frame member 14 can slide along the slot 66. A spring 69, which can be mounted around the second frame member 14, biases the sleeve 62 to the first position (FIG. 4A). To move the sleeve 62 to the second position (FIG. 4B), a user can grip a grip portion 61 of the fold actuator 60, to which the actuator arm 64 is connected, and can squeeze the grip portion 61, causing the sleeves 62 on either second frame member 14 to slide rearwardly. The rearward movement of each sleeve 62 allows the extension 68 to clear the first frame member 12, which in turn allows the base 10 to fold about pivots 16.

Figure 2B:
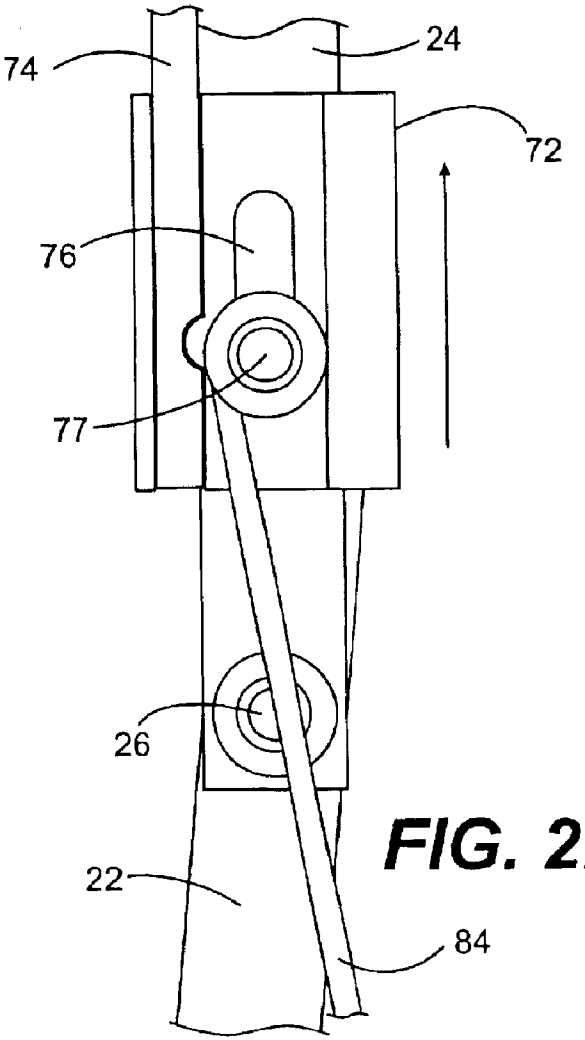
FIGS. 2A and 2B are enlarged side views of a sleeve of a fold mechanism of an upper frame of the infant seat of FIG. 1, where
Figure 2A:
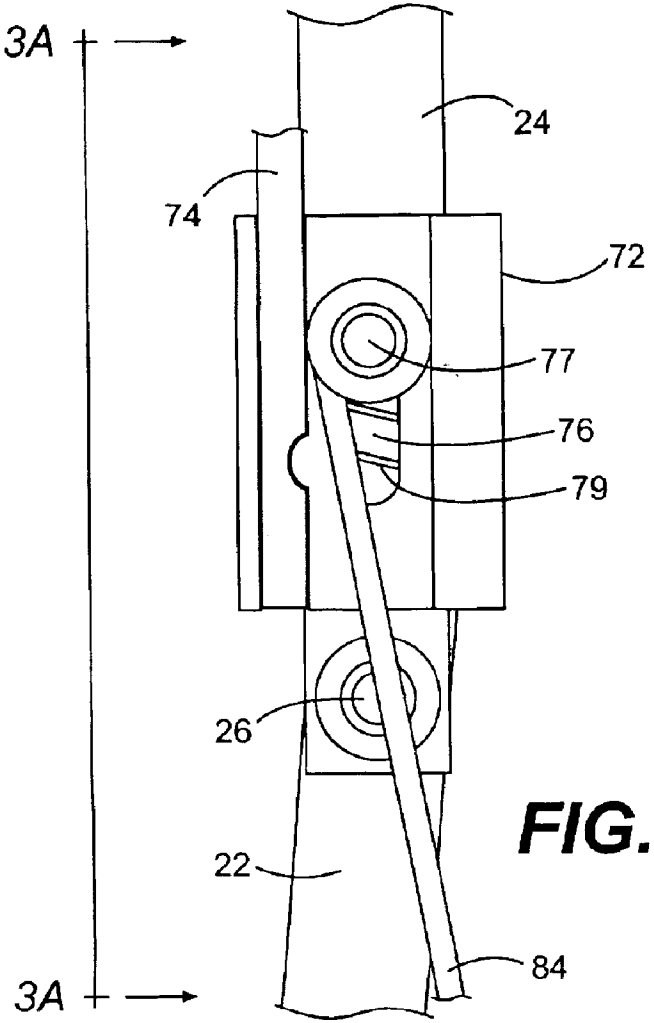
Figure 3B:
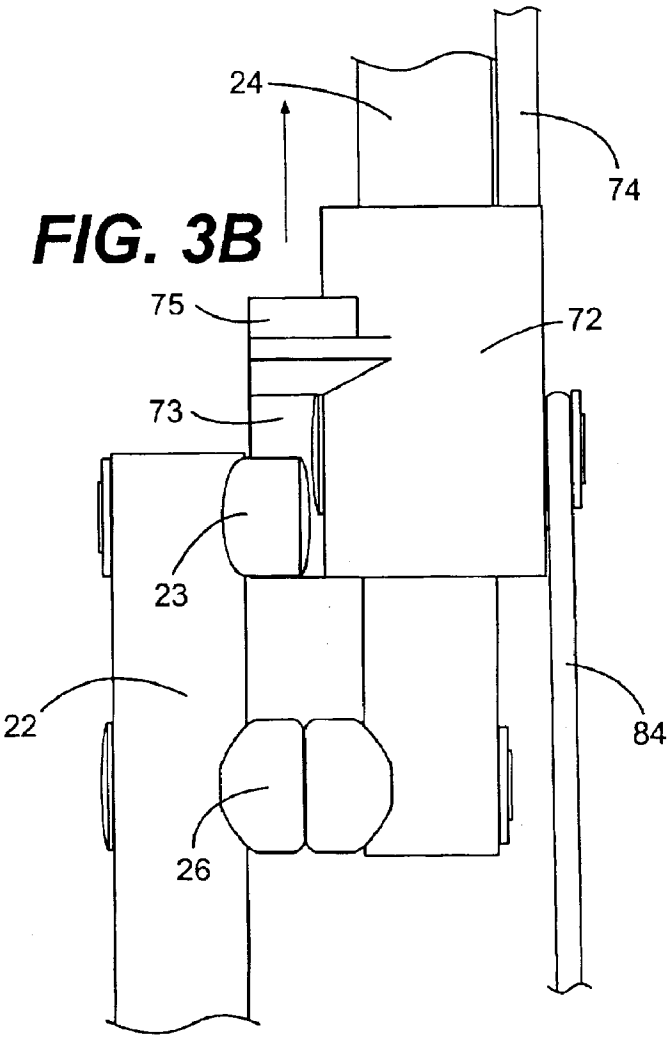
FIGS. 3A and 3B are bottom views of the sleeve of FIGS. 2A and 2B, respectively.
Figure 3A:
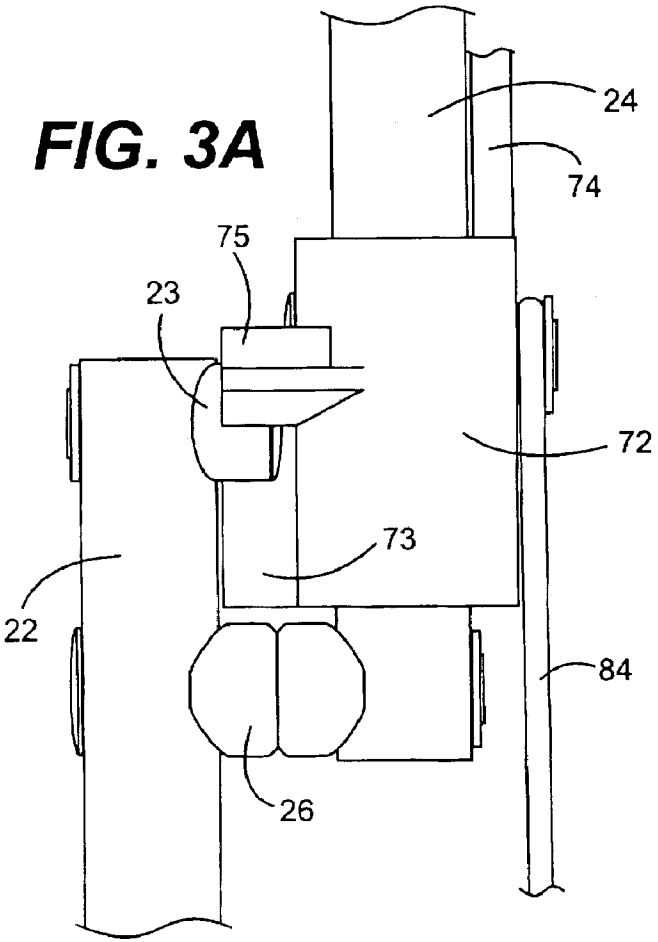

To further facilitate folding of the infant seat 1, the seat 1 can include a fold mechanism mounted to the upper frame 20 to control folding of the upper frame 20 from the in use position to the folded position. The fold mechanism can include a fold actuator 70 mounted to an upper frame member, such as the cross member 28. The fold mechanism also can include a sleeve 72 slidably mounted to each of the fourth frame members 24 to move between a first position in which the upper frame 20 remains in the in use position and a second position in which the upper frame 20 can fold. FIGS. 2A and 3A show the sleeve 72 in the first position, and FIGS. 2B and 3B show the sleeve 72 in the second position. The fold mechanism further can include an actuator arm 74 extending between the fold actuator 70 and each sleeve 72. Like actuator arm 64, actuator arm 74 can comprise a U-shaped wire with the bight of the "U" connected to the fold actuator 70, or it can comprise a pair of wires connected to the fold actuator 70, one wire extending to each sleeve.

Referring to FIGS. 2A,2B, 3A, and 3B, the sleeve 72 includes a slot 76 in which a pin 77 connected to the fourth frame member 24 can slide. A spring 79, which can be mounted around the fourth frame member 24, biases the sleeve 72 to the first position (FIGS. 2A and 3A). To move the sleeve 72 to the second position (FIGS. 2B and 3B), a user can grip a grip portion 71 of the fold actuator 70, to which the actuator arm 74 is connected, and can squeeze the grip portion 71, causing the sleeves 72 on either fourth frame member 74 to slide rearwardly. The rearward movement of each sleeve 72 allows the upper frame 24 to fold about pivots 26.

In this regard, the third frame members 22 each can include a stop 23, and the sleeves 72 each can include a first extension 73 and a second extension 75 that extend on opposite sides of the stop 23 to limit movement of the fourth frame member 24 relative to the third frame member 22 when the infant seat 1 is in the in use position. The first extension 73 is longer than the second extension 75. That is, the first and second extensions 73, 75 are configured to interact with the stop 23 so that, when the fold actuator 70 is actuated, the first extension 73 blocks movement of the fourth frame member 24 relative to the third frame member 22 in one direction (clockwise in FIG. 1) and the second extension 75 permits movement of the fourth frame member 24 relative to the third frame member 22 in an opposite direction (counter-clockwise in FIG. 1). As can be seen in FIG. 3B, when the fold actuator 70 is actuated, the second extension 75 clears the stop 23 to allow pivoting movement of the fourth frame member 24 relative to the third frame member 22 about pivot 26.

The upper frame 20 of the foldable infant seat 1 also can include a seat base support 80 extending between and pivotally connected to the third frame members 22 on each side of the seat 1. The seat base support 80 is pivotally connected to the third frame members 22 at pivots 81. The seat base support 80 comprises a generally U-shaped frame member having a pair of arms, each arm 82 being pivotally connected to a respective third frame member 22. The fabric covering (not shown) that covers the upper frame 20 of the seat 1 also can cover the seat base support 80. The fabric covering, when mounted to the U-shaped frame member formed by members 24, 28 and to the U-shaped seat base support 80, creates a hammock-like seating area for the infant, as illustrated, for example, in U.S. Pat. No. 5,411,315. Linkages 84, which extend between each sleeve 72 and the respective arm 82 of the support 80, ensure that the seat base support 80 remains at an appropriate angle relative to the fourth frame members 24 when the seat 1 is in the in use position.

Folding of the infant seat 1 will now be described in connection with FIGS. 5–10. As will become apparent from the following description, the base 10 of the infant seat 1 is foldable at a location intermediate a front end of the base 10 and a back end of the base 10, and the upper frame 20 is foldable at a location intermediate a front end of the upper frame 20 and a back end of the upper frame 20. By locating the pivots 16, 26 at approximately the midpoint of the base 10 and upper frame 20, respectively, the length of the infant seat 1 can be approximately halved when moved from its in use position to its folded position.

Figure 5:
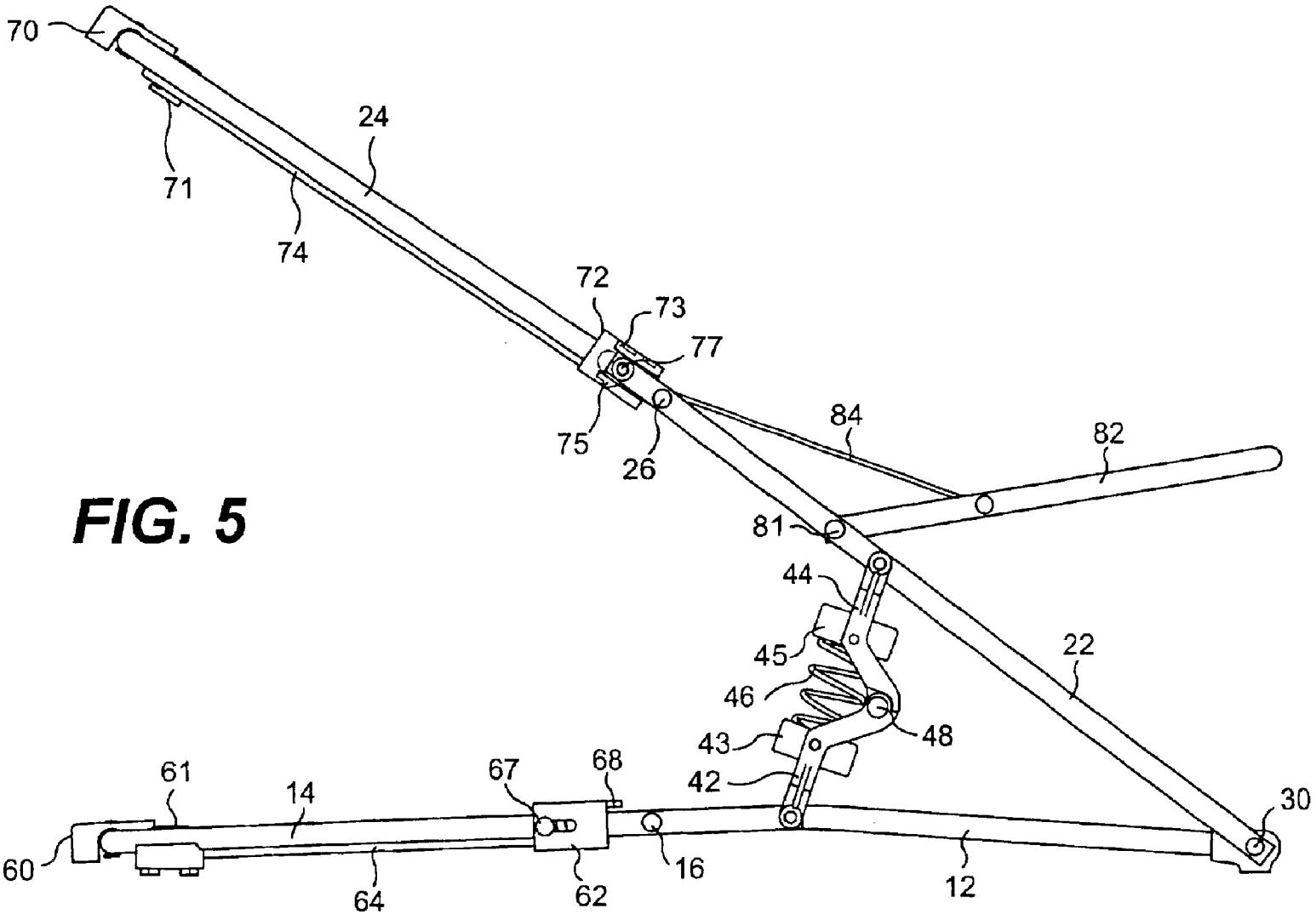
FIG. 5 is a side elevation view of the infant seat in an in use position according to an exemplary embodiment of the present invention.
Figure 6:
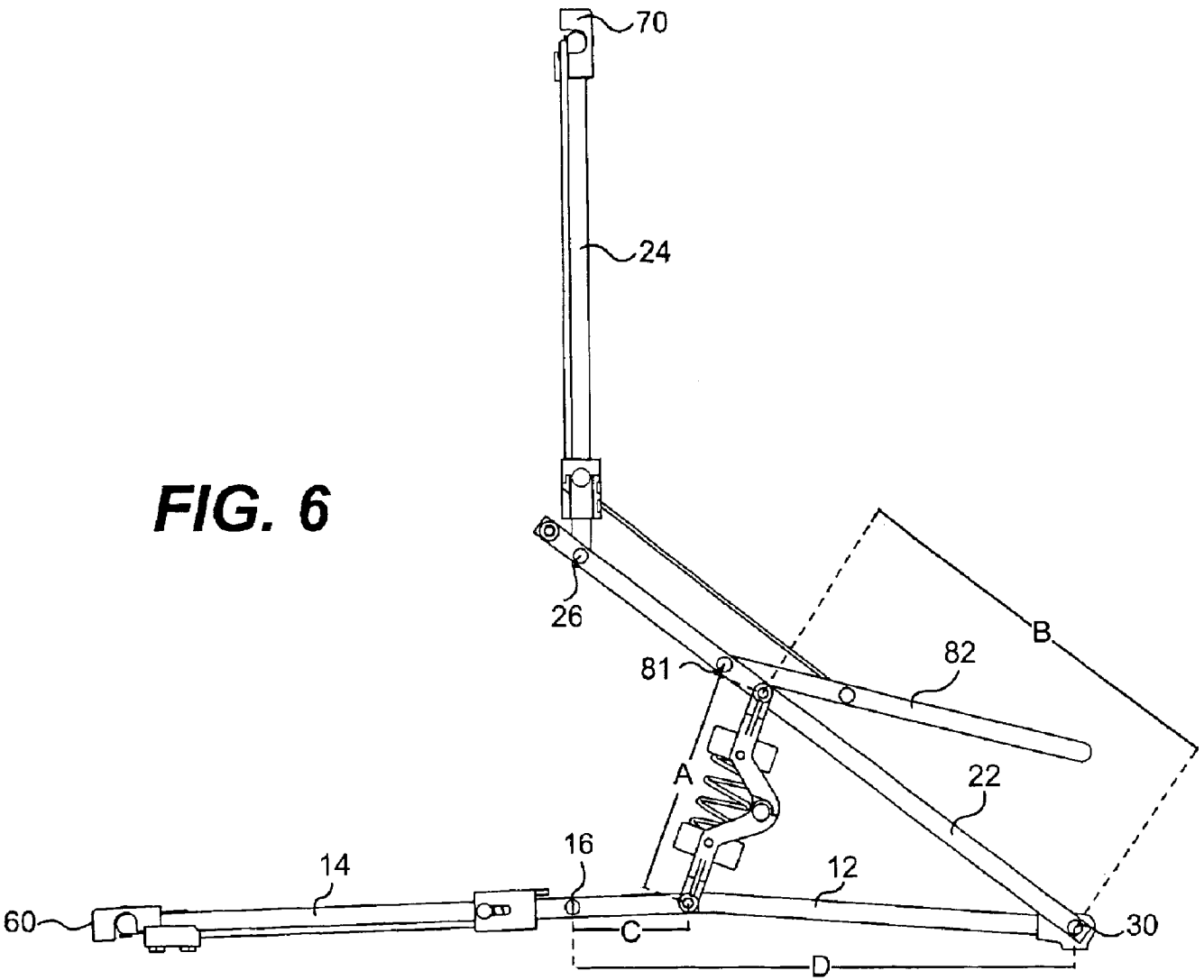
FIG. 6 is a side elevation view of the infant seat of FIG. 5, with the upper frame in a partially folded position.

FIG. 5 shows the infant seat 1 in its in use position according to an exemplary embodiment of the present invention. To initiate the folding operation, a user can actuate the fold actuator 70 of the upper frame 20 and rotate the fourth frame members 24 about pivots 26 toward the third frame members 22, as shown in FIG. 6. FIG. 6 shows the upper frame in a partially folded position. Actuating the fold actuator 70 allows the second extensions 75 of sleeves 72 to clear stops 23, which allows pivoting movement of the fourth frame members 24 relative to the third frame members 22.

FIG. 6 also shows how the fold geometry of this embodiment of the infant seat 1 employs a four-bar linkage. The spring assembly 40 comprises the first link (link A). The length of the third frame member between its front end and its connection to the spring assembly 40 comprises the second link (link B). The length of the first frame member 12 between pivot 16 and its connection to the spring assembly 40 comprises the third link (link C). Finally, the length of the first frame member 12 between its front end and pivot 16 comprises the fourth link (link D). According to the fold geometry of the infant seat 1, the sum of links A and B equals the sum of links C and D (link A+link B=link C+link D). When this four-bar linkage is collapsed, the infant seat 1 is arranged in a generally flat configuration, as shown in FIG. 9.

Figure 7:
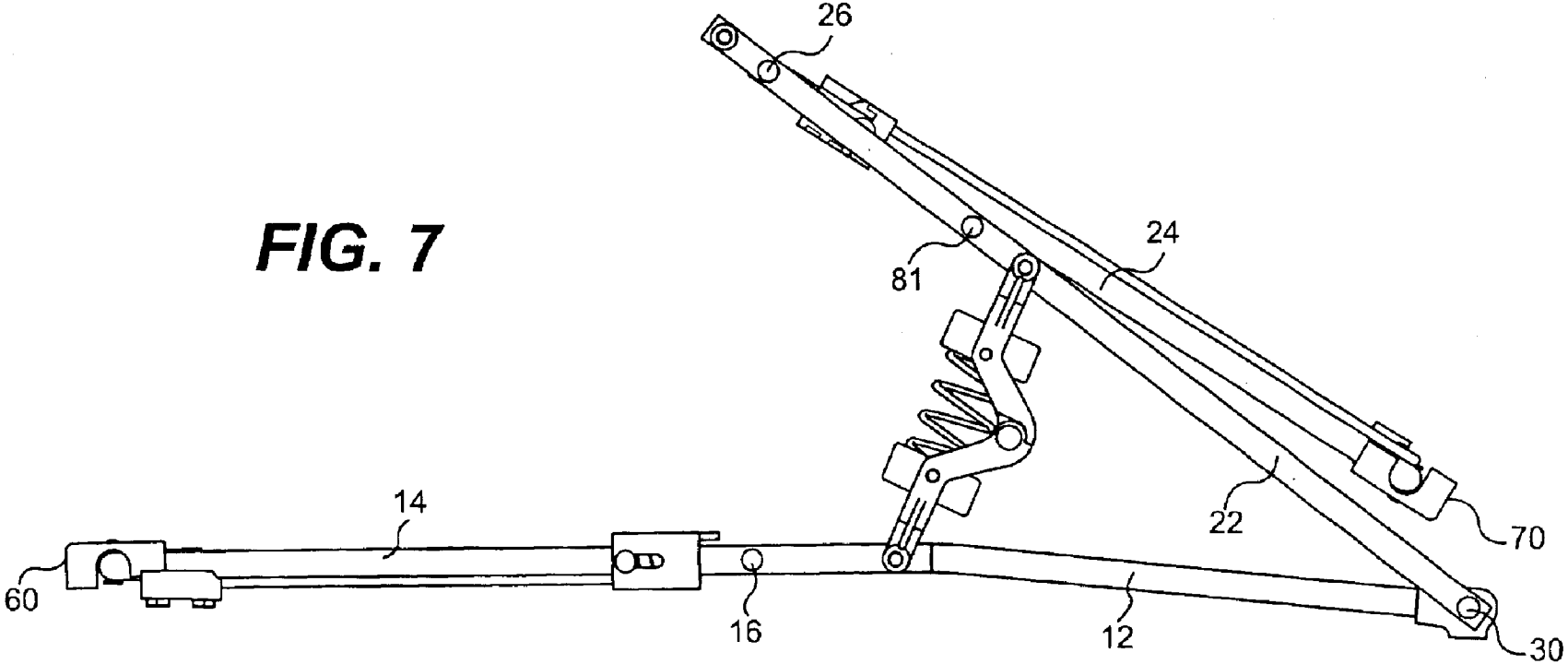
FIG. 7 is a side elevation view of the infant seat of FIG. 5, with the upper frame in a fully folded position.

FIG. 7 shows the upper frame 20 in a fully folded position. In this position, the seat base support 80 is obscured from view by the third frame member 22.

Figure 8:
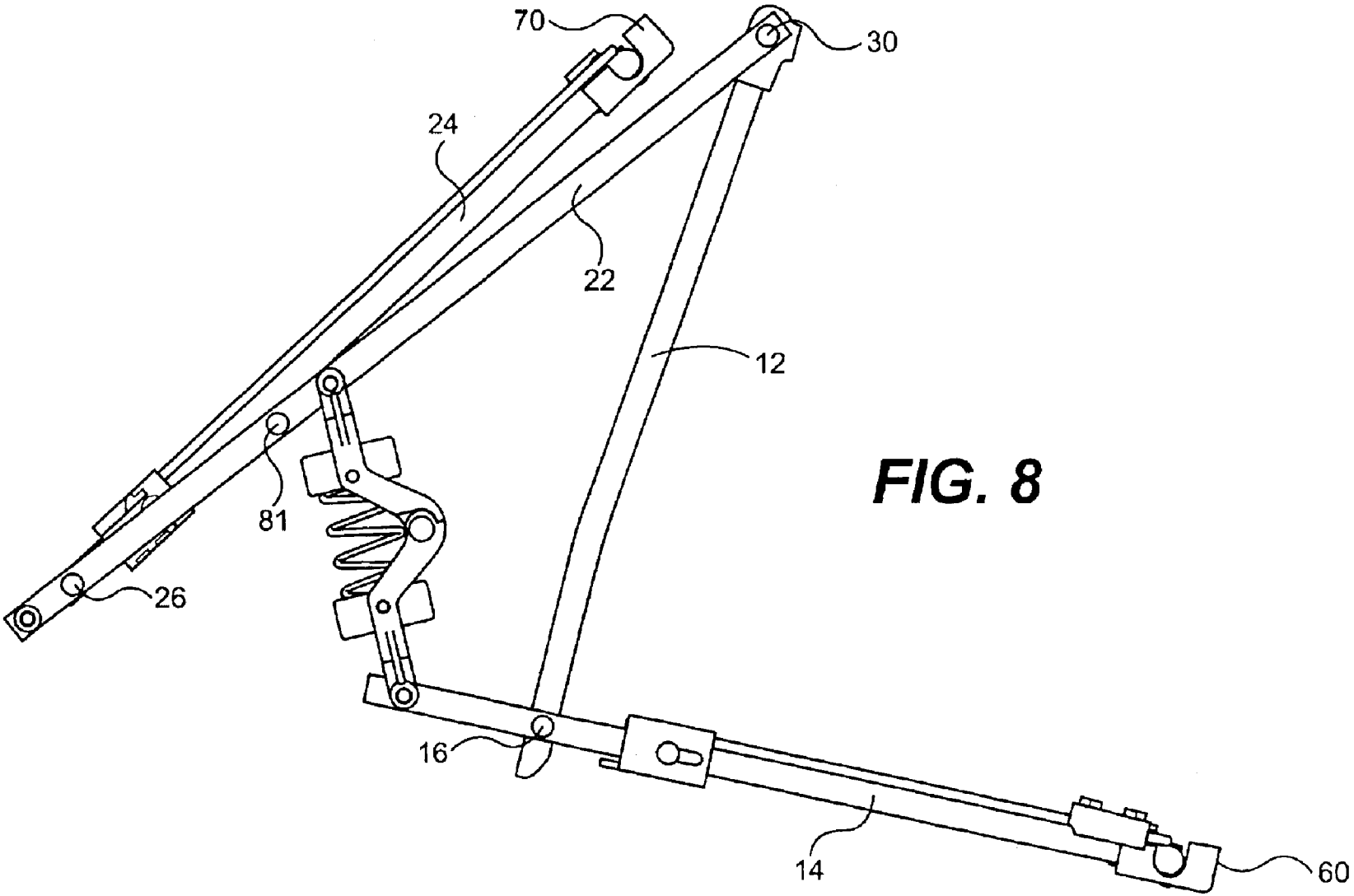
FIG. 8 is a side elevation view of the infant seat of FIG. 5, with the base in a partially folded position.

Once the upper frame 20 has been folded, the base 10 can be folded by actuating the fold actuator 60. FIG. 8 shows the base 10 in a partially folded position. To fold the base 10, a user can grip the grip portion 61 of the fold actuator 60, to which the actuator arm 64 is connected, and can squeeze the grip portion 61, causing the sleeves 62 on the second frame members 14 to slide rearwardly. The rearward movement of the sleeves 62 allows extensions 68 to clear first frame members 12, which in turn allows the base 10 to fold about pivots 16. The spring assembly 40, as part of the four-bar linkage discussed above, facilitates collapse of the base 10 relative to the upper frame 20. FIG. 9 shows the base 10 in its fully folded position.

Figure 9:
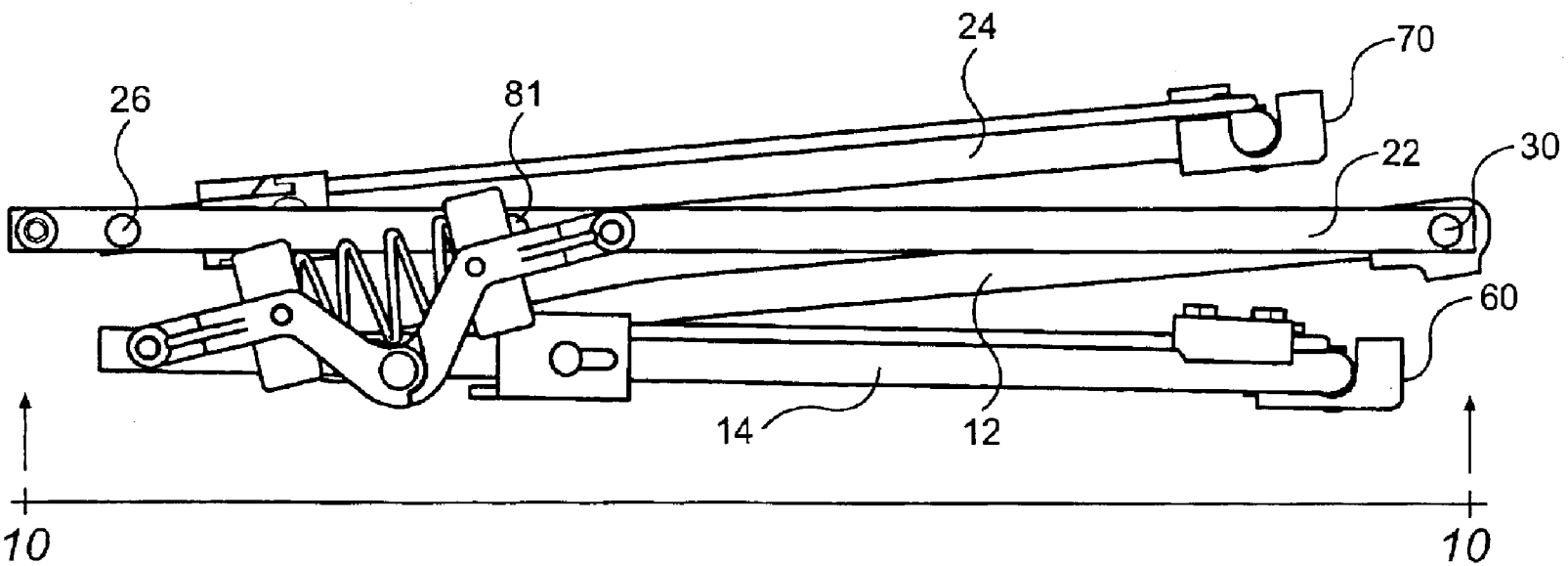
FIG. 9 is a side elevation view of the infant seat of FIG. 5, with the base in a fully folded position.
Figure 10:
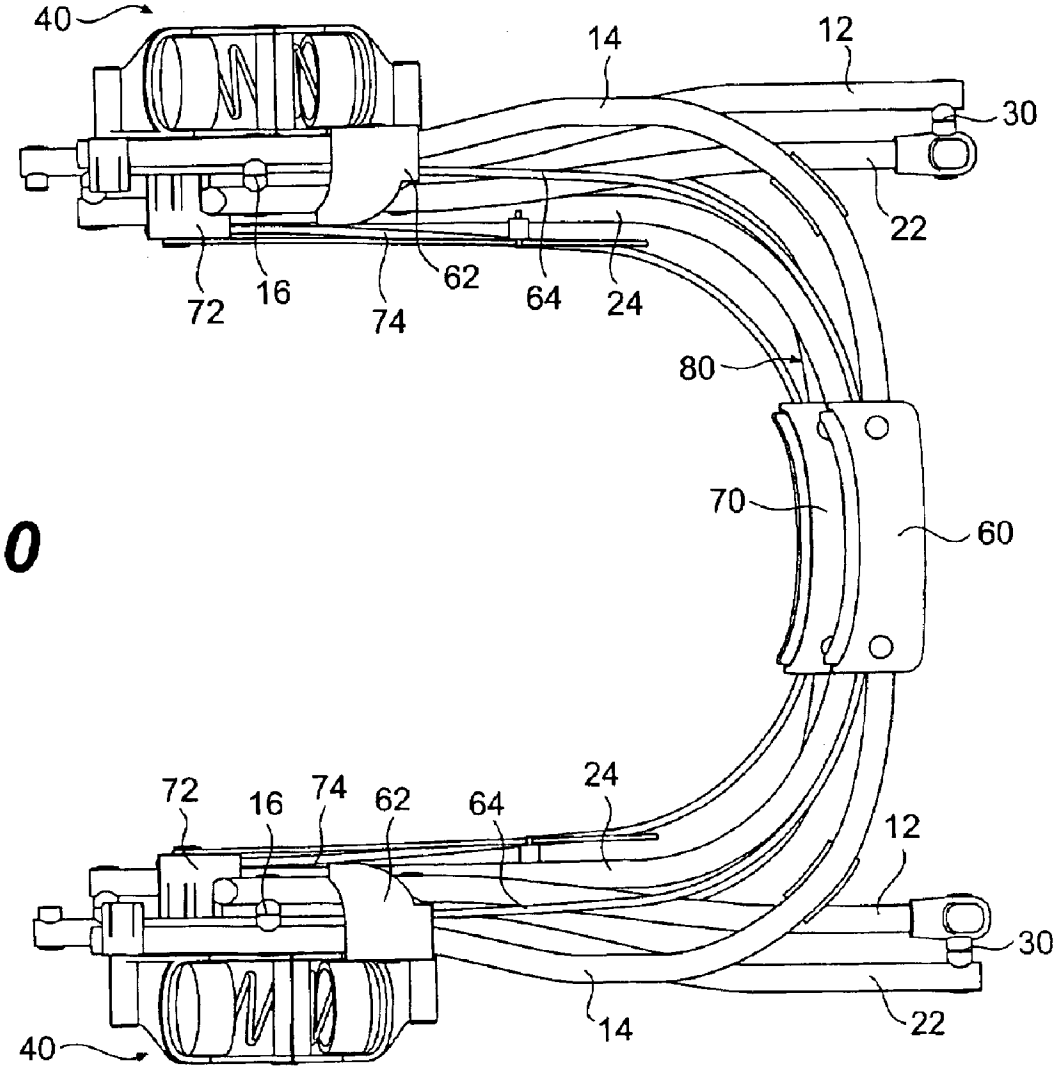
FIG. 10 is a bottom plan view of the frame of the infant seat in a fully folded position.

As can be seen in FIGS. 9 and 10, the infant seat 1 folds to a compact size, which facilitates storage of the infant seat 1 during periods of non-use and packing of the infant seat 1 for travel. Because the base 10 of the infant seat 1 folds, the length of the infant seat 1, when folded, can be smaller than the length of the footprint of the infant seat, when in use.

In the embodiment of FIG. 9, the frame members, such as members 12, 14, 22, 24, lie on top of each other. The present invention also contemplates an embodiment in which the frame members are configured so that they nest and lie next to each other to create a flatter side profile. For example, viewing the infant seat from the front, the frame members of the base 10 can be configured so that they are sufficiently inset from the frame members of the upper frame 20 so that the frame members of the base and the upper frame lie adjacent to each other when folded. In such an embodiment, the frame members of the upper frame 20 and the base 10 can nest, side-by-side, to make the side profile of the infant seat flatter than shown in FIG. 9.

The frame members of the infant seat 1, for example, members 12, 14, 22, 24, can be formed by metal tubing, which, due to strength characteristics of metal tubing, allows the frame to be folded to a very small size. The tubular members can have a circular cross section or any other cross section of suitable strength. Alternatively, the frame members can be formed from molded plastic or composite materials with a cross section of suitable strength.

The preferred embodiments have been set forth herein for the purpose of illustration. This description, however, should not be deemed to be a limitation on the scope of the invention. Various modifications, adaptations, and alternatives may occur to one skilled in the art without departing from the claimed inventive concept. The true scope and spirit of the invention are indicated by the following claims.

What is claimed is:

1. A foldable infant seat comprising:

a base, each side of the base including a first frame member and a second frame member pivotally connected together;

an upper frame, each side of the upper frame including a third frame member and a fourth frame member pivotally connected together, the first frame member of the base and the third frame member of the upper frame on each side of the seat being pivotally connected together; and a link on each side of the seat that is pivotally connected to at least one of the first and second frame members of the base and to an intermediate portion of the upper frame, wherein the base, the upper frame, and the link are moveable between an in use position and a folded position, and a length of the base is greater in the in use position than in the folded position.

2. A foldable infant seat according to claim 1, wherein the link is pivotally connected to and extends between the second frame member of the base and the third frame member of the upper frame.

3. A foldable infant seat according to claim 1, wherein the link comprises a rigid member.

4. A foldable infant seat according to claim 1, wherein the link comprises a resilient member.

5. A foldable infant seat according to claim 4, wherein the resilient member comprises a spring assembly.

6. A foldable infant seat according to claim 1, further comprising a fold mechanism mounted to the base to control folding of the base from the in use position to the folded position.

7. A foldable infant seat according to claim 6, wherein the base further comprises a first cross member that extends between the second frame members of each side of the seat to form a generally U-shaped base frame member.

8. A foldable infant seat according to claim 7, wherein the fold mechanism comprises a fold actuator mounted to the first cross member, a sleeve slidably mounted to each of the second frame members to move between a first position in which the base remains is the in use position and a second position in which the base can fold, and an actuator arm extending between the fold actuator and each sleeve.

9. A foldable infant seat according to claim 8, wherein the sleeve has an extension that at least partially overlaps the respective first frame member to prevent folding of the base absent actuation of the fold actuator.

10. A foldable infant seat according to claim 1, further comprising a seat base support extending between and pivotally connected to the third member of each side of the seat.

11. A foldable infant seat according to claim 1, further comprising a fold mechanism mounted to the upper frame to control folding of the upper frame from the in use position to the folded position.

12. A foldable infant seat according to claim 11, wherein the upper frame further comprises a cross member that extends between the fourth frame members of each side of the seat to form a generally U-shaped upper frame member.

13. A foldable infant seat according to claim 12, wherein the fold mechanism comprises a fold actuator mounted to the second cross member, a sleeve slidably mounted to each of the fourth frame members to move between a first position in which the upper frame remains in the in use position and a second position in which the upper frame can fold, and an actuator arm extending between the fold actuator and each sleeve.

14. A foldable infant seat according to claim 13, wherein the third frame members each include a stop, and the sleeves each include a first extension and a second extension on opposite sides of the stop to limit movement of the fourth frame member relative to the third frame member in the in use position.

15. A foldable infant seat according to claim 14, wherein the first and second extensions are configured to interact with the stop so that, when the fold actuator is actuated, the first extension blocks movement of the fourth frame member relative to the third frame member in one direction and the second extension permits movement of the fourth frame member relative to the third frame member in an opposite direction.

16. A foldable infant seat comprising:

a base, each side of the base having first and second frame members pivotally connected together; and an upper frame pivotally connected to the base;

wherein the infant seat is configurable in an in use position and a folded position, the upper frame can bounce relative to the base in the in use position, and the base has a shorter length in the folded position than in the in use position.

17. A foldable infant seat according to claim 16, further comprising a link on each side of the seat that is pivotally connected to the base and to an intermediate portion of the upper frame.

18. A foldable infant seat according to claim 17, wherein the link is a spring assembly.

19. A foldable infant seat comprising:

a base, having a shorter length in the folded position than in the use position, that is foldable at a location intermediate a front end of the base and a back end of the base;

an upper frame pivotally connected to the base at a front of the seat, the upper frame being foldable at a location intermediate a front end of the upper frame and a back end of the upper frame, the base and the upper frame being moveable between an in use position and a folded position; and a link on each side of the seat that extends between the base and an intermediate portion of the upper frame.

20. A foldable infant seat according to claim 19, wherein the link is a spring assembly.

21. A foldable infant seat according to claim 20, wherein the base is generally U-shaped, and the upper frame is generally U-shaped.

22. A foldable infant seat comprising:

a base, each side of the base having first and second frame members movably connected together; and an upper frame movably connected to the base, each side of the upper frame including a third frame member and a fourth frame member movably connected together;

wherein the infant seat is configurable in an in use position and a folded position, and the base and the upper frame both have a shorter length in the folded position than in the in use position.

* * * * *